US009091978B2

(12) United States Patent
Maruyama et al.

(10) Patent No.: US 9,091,978 B2
(45) Date of Patent: Jul. 28, 2015

(54) FIXING DEVICE PROVIDED WITH STAY HAVING RIGIDITY DISTRIBUTION

(71) Applicant: Brother Kogyo Kabushiki Kaisha, Nagoya-shi, Aichi-ken (JP)

(72) Inventors: Yasuhiro Maruyama, Kasugai (JP); Tomoaki Hazeyama, Yokkaichi (JP); Naoyuki Iwata, Kakamigahara (JP); Yusuke Murodate, Nagoya (JP); Akihiro Kobayashi, Inazawa (JP); Yuji Nishigaki, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/227,025

(22) Filed: Mar. 27, 2014

(65) Prior Publication Data

US 2014/0294464 A1 Oct. 2, 2014

(30) Foreign Application Priority Data

Mar. 29, 2013 (JP) ..... 2013-074374

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053; G03G 2215/2035
USPC ..... 399/329
See application file for complete search history.

(56) References Cited

U.S. PATENT DOCUMENTS

| | | | | |
|---|---|---|---|---|
| 6,775,509 | B2 | 8/2004 | Shida et al. | |
| 2003/0156866 | A1 | 8/2003 | Shida et al. | |
| 2011/0158718 | A1* | 6/2011 | Fujiwara et al. | 399/329 |
| 2011/0170920 | A1 | 7/2011 | Fujiwara et al. | |
| 2011/0211881 | A1* | 9/2011 | Suzuki et al. | 399/329 |
| 2012/0275831 | A1* | 11/2012 | Ishida et al. | 399/329 |

FOREIGN PATENT DOCUMENTS

| | | | |
|---|---|---|---|
| JP | 2003-228246 | A | 8/2003 |
| JP | 3817482 | B2 | 9/2006 |
| JP | 2011-137933 | A | 7/2011 |

OTHER PUBLICATIONS

Co-pending U.S. Appl. No. 14/227,011, filed Mar. 27, 2014.
Co-pending U.S. Appl. No. 14/227,016, filed Mar. 27, 2014.
Co-pending U.S. Appl. No. 14/227,040, filed Mar. 27, 2014.

* cited by examiner

*Primary Examiner* — Sandra Brase
(74) *Attorney, Agent, or Firm* — Banner & Witcoff, Ltd.

(57) ABSTRACT

A fixing device may include a nip member, an endless belt, a rotating body, and a stay. The endless belt may be in sliding contact with the nip member. The rotating body may nip the endless belt to constitute a nip region. The stay may be disposed opposite to the nip region, and may receive a pressure from the nip member. A pressure direction may be defined as a first direction. The rotating body may define an axial direction as a second direction. The stay may have a first wall. The first wall may include a center portion, a first end portion, a second end portion and a supporting portion. The first end portion may include a first low rigidity portion. The second end portion may include a second low rigidity portion. The supporting portion may provide a convex shape protruding toward the nip member upon receiving the pressure.

20 Claims, 7 Drawing Sheets

FIXING DEVICE PROVIDED WITH STAY HAVING RIGIDITY DISTRIBUTION

CROSS REFERENCE TO RELATED APPLICATION

This application claims priority from Japanese Patent Application No. 2013-074374 filed Mar. 29, 2013. The entire content of the priority application is incorporated herein by reference.

TECHNICAL FIELD

The present invention relates to a fixing device that thermally fixes a transferred developing agent image to a sheet.

BACKGROUND

Japanese Patent No. 3817482 discloses a fixing device that includes an endless belt, a nip member disposed at an internal space of the endless belt, and a pressure roller that opposes the nip member so as to interpose the endless belt between the pressure roller and the nip member. More specifically, the nip member is subjected to machining to have a convex surface in contact with the endless belt and having a central portion and end portions in an axial direction of the endless belt. The central portion has a protruding amount protruding toward the pressure roller greater than that of the end portions. In this way, wrinkling of recording sheets can be prevented.

SUMMARY

However, with the conventional technology, the protruding amount of the central portion of the nip member must be directly adjusted by machining the surface of the nip member to be in contact with the endless belt. Here, accurate machining is troublesome, and dimensional error may occur in the amount of protrusion.

In view of the foregoing, it is an object of the present invention to provide a fixing device capable of reducing dimensional error in the protrusion amount of the central portion of the nip member.

In order to attain the above and other objects, the present invention provides a fixing device for fixing an image onto a recording sheet that may include a nip member, an endless belt, a rotating body, and a stay. The endless belt may have an outer peripheral surface and an inner peripheral surface configured to be in sliding contact with the nip member. The rotating body may be configured to nip the endless belt in cooperation with the nip member to form a nip region between the endless belt and the rotating body. The stay may be disposed opposite to the nip region with respect to the nip member, and may be configured to receive a pressure from the nip member. A pressure direction from the nip member to the stay may be defined as a first direction. The rotating body may have an axis defining an axial direction as a second direction. The stay may have a first wall extending in the first direction and the second direction and having a thickness in a third direction perpendicular to the first direction and the second direction.

The first wall may include a center portion, a first end portion, a second end portion and a supporting portion. The first end portion may include a first low rigidity portion having a rigidity lower than that of the center portion. The second end portion may be opposite to the first end portion with respect to the center portion in the second direction. The second end portion may include a second low rigidity portion having a rigidity lower than that of the center portion. The supporting portion may be configured to support the nip member and receive the pressure, and may be configured to provide a convex shape protruding toward the nip member upon receiving the pressure.

DETAILED DESCRIPTION

Figure 1:
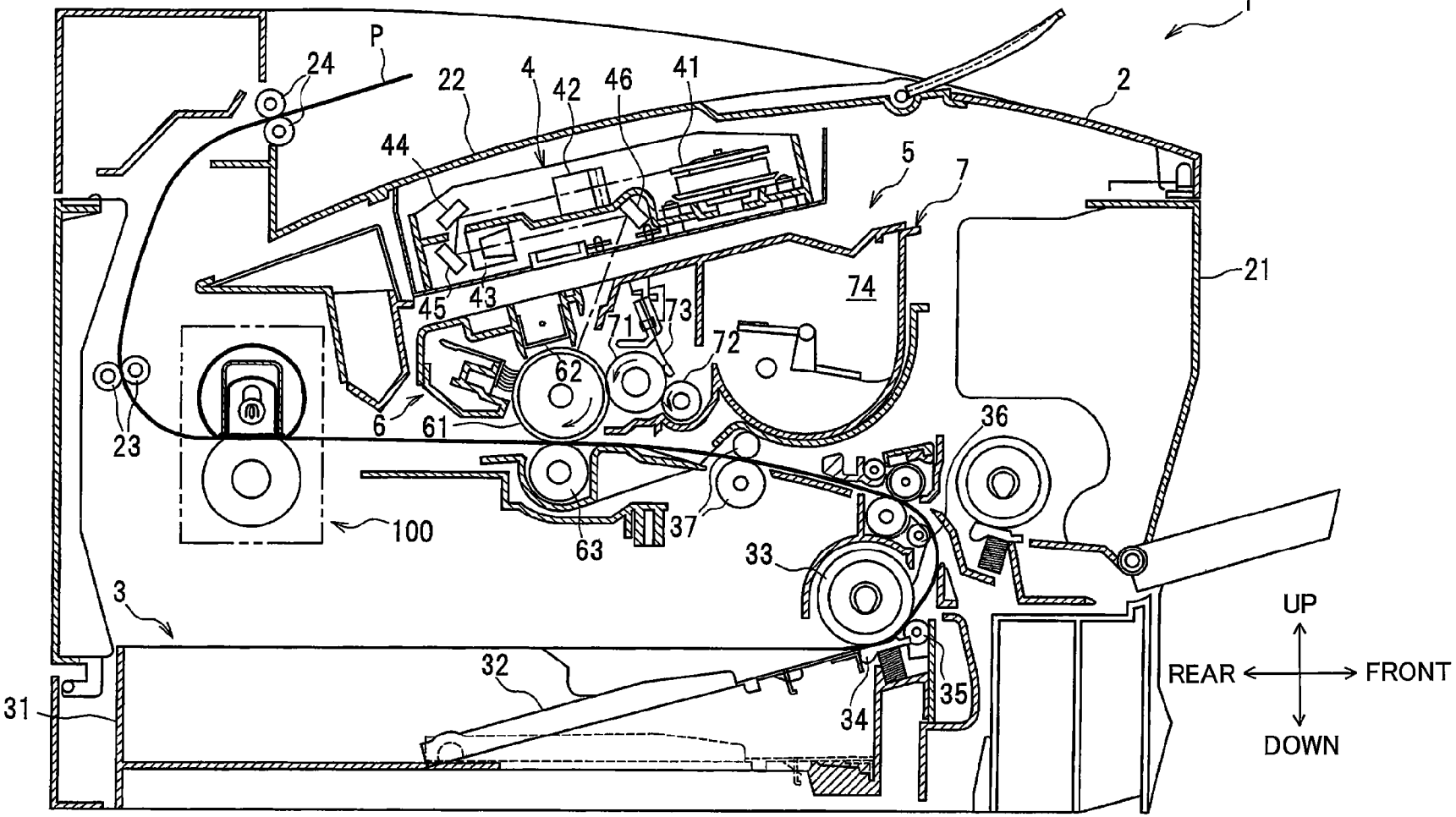
FIG. 1 is a schematic cross-sectional view showing a structure of a laser printer having a fixing device according to one embodiment of the present invention.

A general structure of a laser printer as an image forming device according to one embodiment of the present invention will be described with reference to FIG. 1. A laser printer 1 shown in FIG. 1 is provided with a fixing device 100 according to the embodiment of the present invention. A detailed structure of the fixing device 100 will be described later while referring to FIGS. 2 to 4B.

<General Structure of Laser Printer>

As shown in FIG. 1, the laser printer 1 includes a main frame 2. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" will be used assuming that the laser printer 1 is disposed in an orientation in which it is intended to be used. More specifically, in FIG. 1, a left side and a right side of the figure are a rear side and a front side of the printer, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35 and 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35 and 36, and the registration rollers 37.

The exposure unit 4 is disposed at an upper portion of the main frame 2. The exposure unit 4 includes a laser emission unit (not shown), a polygon mirror 41, lenses 42 and 43, and reflection mirrors 44, 45 and 46. In the exposure unit 4, the laser emission unit is adapted to project a laser beam based on image data so that the laser beam is deflected by or passes through the polygon mirror 41, the lens 42, the reflection mirrors 44 and 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a doctor blade 73 for regulating toner thickness, and a toner accommodating portion 74 in which toner is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the doctor blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
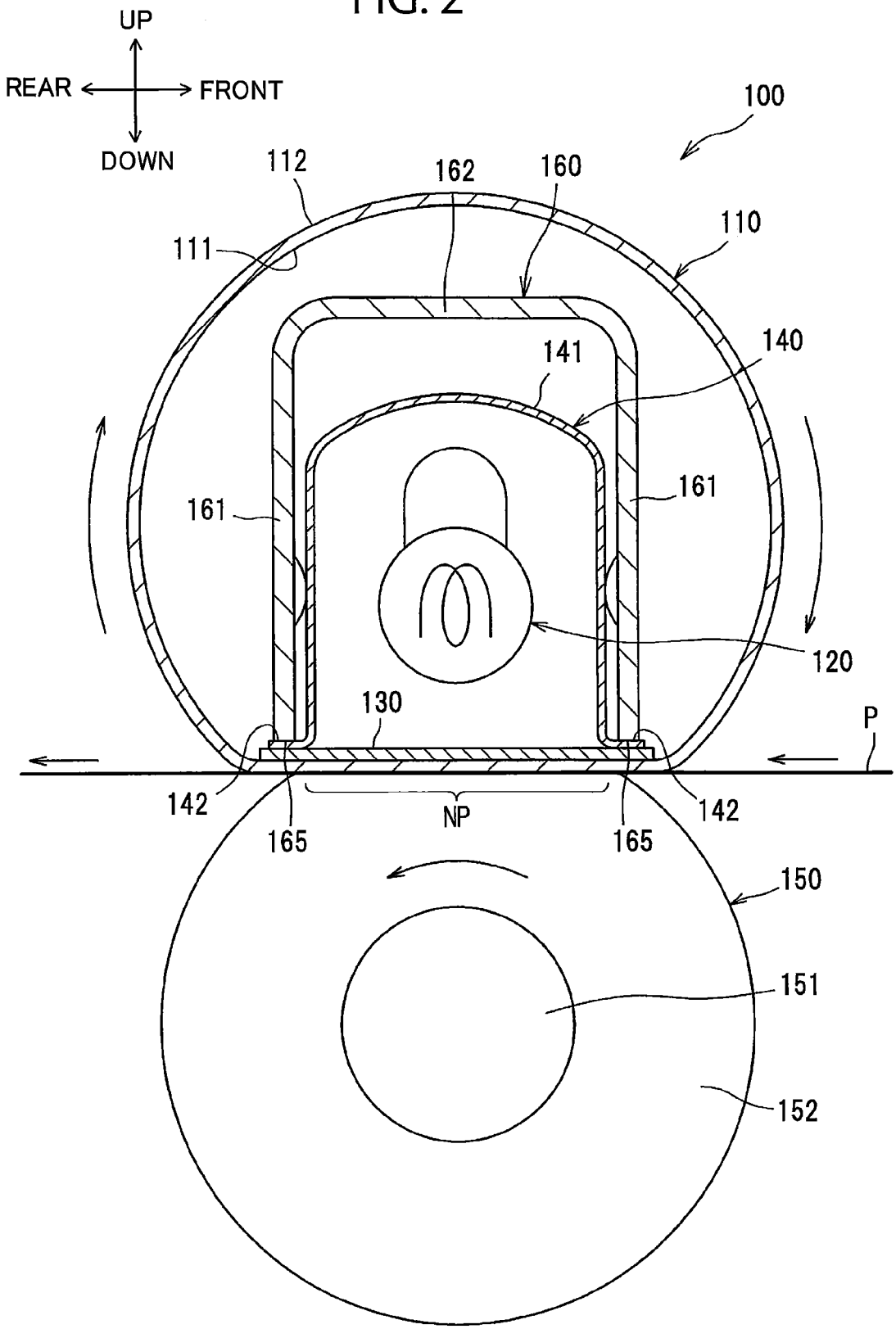
FIG. 2 is a cross-sectional view of the fixing device.
Figure 3:
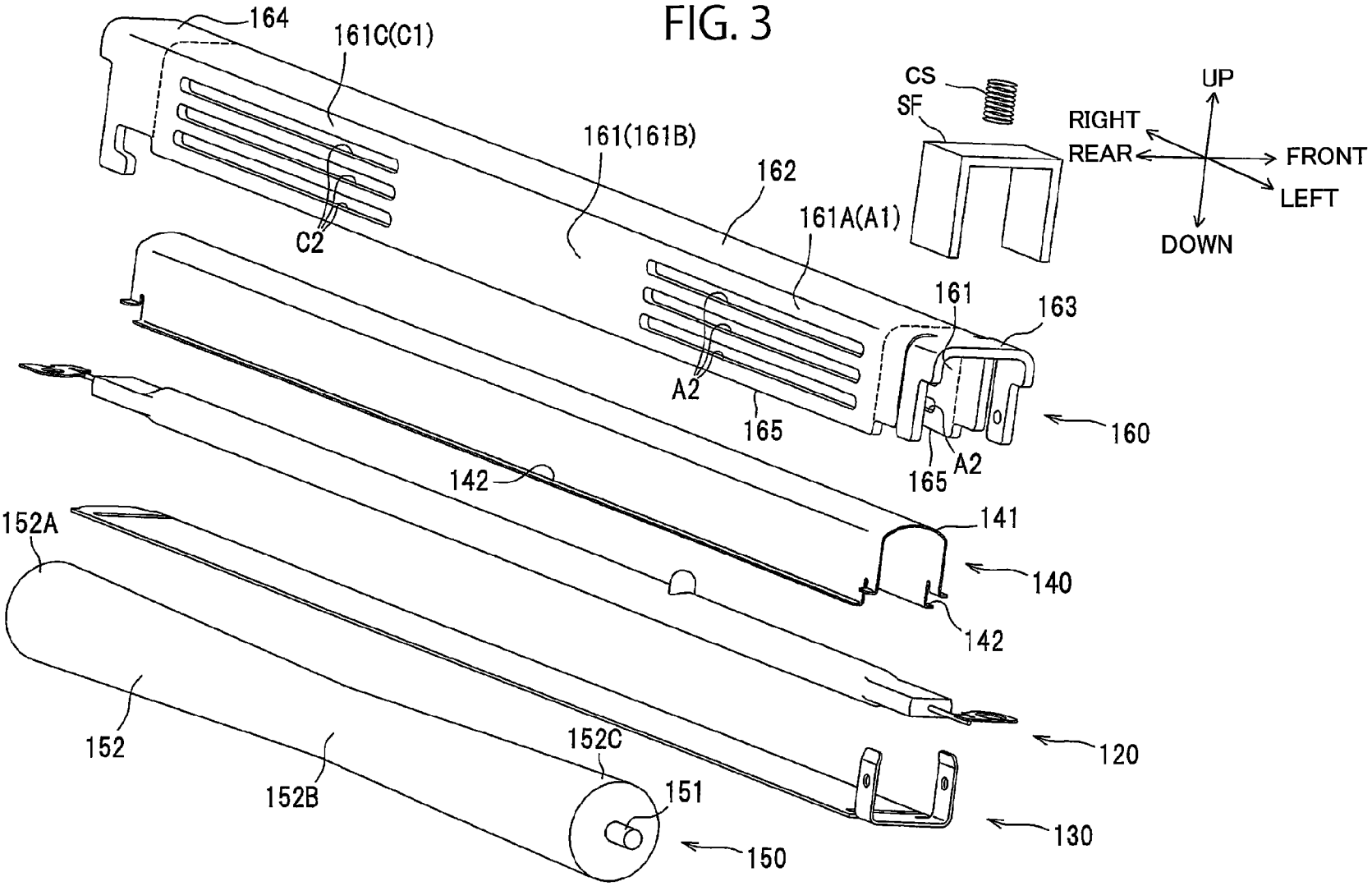
FIG. 3 is an exploded perspective view showing a halogen lamp, a nip plate, a reflection plate, a pressure roller, and a stay.

As shown in FIGS. 2 and 3, the fixing device 100 includes a fusing belt 110, a halogen lamp 120, a nip plate 130, a reflection plate 140, a pressure roller 150, and a stay 160. In FIG. 3, for the sake of convenience a length of the pressure roller 150 in a leftward/rightward direction is shown as being shorter than that of the nip plate 130, but in actuality the length of the pressure roller 150 in the leftward/rightward direction is approximately the same as that of the nip plate 130. (See FIG. 4A.)

The fusing belt 110 is a heat-resistant and flexible endless belt. The fusing belt 110 has a metallic tube and a fluorocarbon resin layer coated thereover. The metallic tube is made from stainless steel. The fusing belt 110 has an inner peripheral surface 111 in sliding contact with the nip plate 130, and an outer peripheral surface 112 in sliding contact with the pressure roller 150.

The inner peripheral surface 111 is in sliding contact with the nip member and runs rearward relative to the nip plate 130. Here, the sliding contact direction of the inner peripheral surface 111 relative to the nip plate 130 refers to an average direction in which the inner peripheral surface 111 is in sliding contact with any points of the nip plate 130 in the frontward/rearward direction. In this embodiment, the sliding contact direction refers to a direction extending in the frontward/rearward direction in FIG. 2. In other words, the sliding contact direction refers to a direction that extends from an upstream end to a downstream end of a nip region NP relative to a rotation direction of the pressure roller 150.

As a modification to the fusing belt 110, a rubber layer can be provided between the metallic tube and the fluorocarbon resin layer.

The halogen lamp 120 is a heater to generate a radiant heat to heat the nip plate 130 and the fusing belt 110 for heating toner on the sheet S. The halogen lamp 120 is positioned at the internal space of the fusing belt 110 such that the halogen lamp 120 is spaced away from the inner peripheral surface of the fusing belt 110 as well as an inner (upper) surface of the nip plate 130 by a predetermined distance.

The nip plate 130 is an elongated member extending in the leftward/rightward direction, and is formed into a substantially plate-like shape. The nip plate 130 is disposed to be in sliding contact with the inner peripheral surface 111 of the tubular fusing belt 110. The nip plate 130 has end portions 131 and a central portion 132 in the leftward/rightward direction. The nip plate 130 is adapted to transfer the radiant heat received from the halogen lamp 120 and onto the toner on the sheet P through the fusing belt 110.

This nip plate 130 is formed into a planar shape and is made from a metal, for example, aluminum, so as to have a thermal conductivity higher than that of a stay 160 made from a steel (described later). This nip plate 130 has a thickness permitting bending deformation thereof. The surface of the nip plate 130 that is in contact with the inner peripheral surface 111 of the fusing belt 110 can be coated with, for example, a metal oxide film or a fluororesin layer. Moreover, the thickness of the nip plate 130 can be ranging from 0.1 to 3.0 mm, or 0.3 to 2.0 mm, or 0.1 to 1.0 mm.

The reflection plate 140 is adapted to reflect radiant heat from the halogen lamp 120 toward the nip plate 130. As shown in FIG. 2, the reflection plate 140 is positioned within the fusing belt 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing belt 110.

The reflection plate 140 is configured into substantially U-shape in cross-section and is made from a material such as aluminum having high reflection ratio for infrared rays or far infrared rays. The reflection plate 140 has substantially a U-shaped reflection portion 141 and a flange portion 142 extending outward from each end portion of the reflection portion 141 in the frontward/rearward direction. A mirror surface finishing is applicable on the surface of the aluminum reflection plate 140 for specular reflection in order to enhance heat reflection ratio.

The pressure roller 150 is an elastically deformable member. The pressure roller 150 is disposed downward of the nip plate 130 to vertically oppose the outer peripheral surface 112 of the fusing belt 110. The pressure roller 150 is rotatable about an axis extending in the leftward/rightward direction. The pressure roller 150 is configured to provide the nip region NP in cooperation with the fusing belt 110, when the fusing belt 110 is nipped between the pressure roller 150 and the nip plate 130 while the pressure roller 150 is in an elastically deformed state.

The pressure roller 150 has a metallic shaft 151 and a rubber layer 152 formed over an outer periphery of the shaft 151. The shaft 151 is formed into a linear shape, with a radius that is substantially constant across the leftward/rightward direction.

The rubber layer 152 has a first end portion 152A, a central portion 152B, and a second end portion 152C, in the axial direction (leftward/rightward direction) of the pressure roller 150. The rubber layer 152 is formed into a concave shape such that respective outer diameters of the end portions 152A and 152C are larger than an outer diameter of the central portion 152B when fixing operation is not being performed (heat is not being applied) and when fixing operation is being performed. In other words, the rubber layer 152 is formed such that the end portions 152A and 152C are thicker than the central portion 152B.

The pressure roller 150 is rotationally driven by a drive motor (not shown) disposed in the main frame 2. By the rotation of the pressure roller 150, the fusing belt 110 is circularly moved along the nip plate 130 because of a friction force generated therebetween or between the sheet P and the fusing belt 110. A toner image on the sheet P can be thermally fixed thereto by heat and pressure during passage of the sheet P at the nip region NP between the pressure roller 150 and the fusing belt 110.

The stay 160 is adapted to support the end portions of the nip plate 130 through the flange portions 142 for maintaining rigidity of the nip plate 130. The stay 160 is positioned on the opposite side of the nip region NP with respect to the nip plate 130. The stay 160 has a substantially U-shape configuration in conformity with the outer shape of the reflection portion 141 covering the reflection plate 140. For fabricating the stay 160, a highly rigid member such as a steel plate is folded into substantially U-shape.

The stay 160 is disposed upward of the reflection plate 140. The stay 160 has a pair of first walls 161, a second wall 162, a left frame 163, and a right frame 164. The first walls 161 are disposed in opposition to each other in the frontward/rearward direction. The second wall 162 is integrally connected to respective upper ends of the first walls 161. The left frame 163 is integrally provided at respective left end sides of the first walls 161 and the second wall 162 (a portion leftward of a broken line on a left side in FIG. 3). The right frame 164 is integrally provided at respective right end sides of the first walls 161 and the second wall 162 (a portion rightward of a broken line on a right side in FIG. 3).

The stay 160 has left and right end portions that are respectively supported by left and right side frames SF (only a left side frame is shown in FIG. 3). The side frames SF are vertically movably supported by a fixing frame (not shown) of the fixing device 100. In addition, the nip plate 130 and the reflection plate 140 are supported indirectly by the side frames SF through the stay 160.

Coil springs CS (only a left coil spring is shown in FIG. 3) are provided for urging the respective side frames SF downward. Thus, the side frames SF press the nip plate 130 toward the pressure roller 150 through the stay 160 and the reflection plate 140. Incidentally, as modifications, the halogen lamp 120 can be supported by the side frames SF or by the fixing frame. Further, the stay 160 and the nip plate 130 can be fixed to the fixing frame, whereas the pressure roller 150 is urged toward the nip plate 130 by a urging member. Moreover, instead of the coil spring CS, a combination of an arm and a coil spring is available.

The second wall 162 constitutes a part of an upper wall of the stay 160 corresponding to the first walls 161, i.e. a part of the upper wall of the stay 160 that is between the broken lines in FIG. 3 in the leftward/rightward direction. The second wall 162 is plate-shaped, extending in the leftward/rightward direction and in the frontward/rearward direction, and having thickness in the upward/downward direction. The second wall 162 has a substantially uniform rigidity distribution in the leftward/rightward direction. Specifically, the second wall 162 is formed with a sufficiently high rigidity that, when the above-described urging member urges the stay 160 toward the pressure roller 150, the second wall 162 does not undergo substantial deformation.

The first walls 161 are plate-shaped, extending in the upward/downward direction and in the leftward/rightward direction, and having thickness in the frontward/rearward direction. The first walls 161 are formed so as to extend downward from front and rear ends of the second wall 162. The first walls 161 have respective first end portions 161A, central portions 161B, and second end portions 161C, in the leftward/rightward direction.

The first walls 161 have respective lower end faces which constitute supporting portions 165. The supporting portions 165 support the nip plate 130 through the flanges 142 of the reflection plate 140. The supporting portions 165 are configured to have respective supporting faces that receive pressure (reactive force) exerted upward from the nip plate 130.

More specifically, the first walls 161 constitute parts of respective front and rear walls of the stay 160 that have the supporting portions 165 which receive the reactive force from the nip plate 130, i.e. portions of the respective front and rear walls of the stay 160 that are between the broken lines in FIG. 3 in the leftward/rightward direction. Incidentally, in the descriptions below, since the respective first walls 161 are formed symmetrically in the frontward/rearward direction, a description of only one of the first walls 161 is provided, while a description of the other is omitted.

Figure 4A:
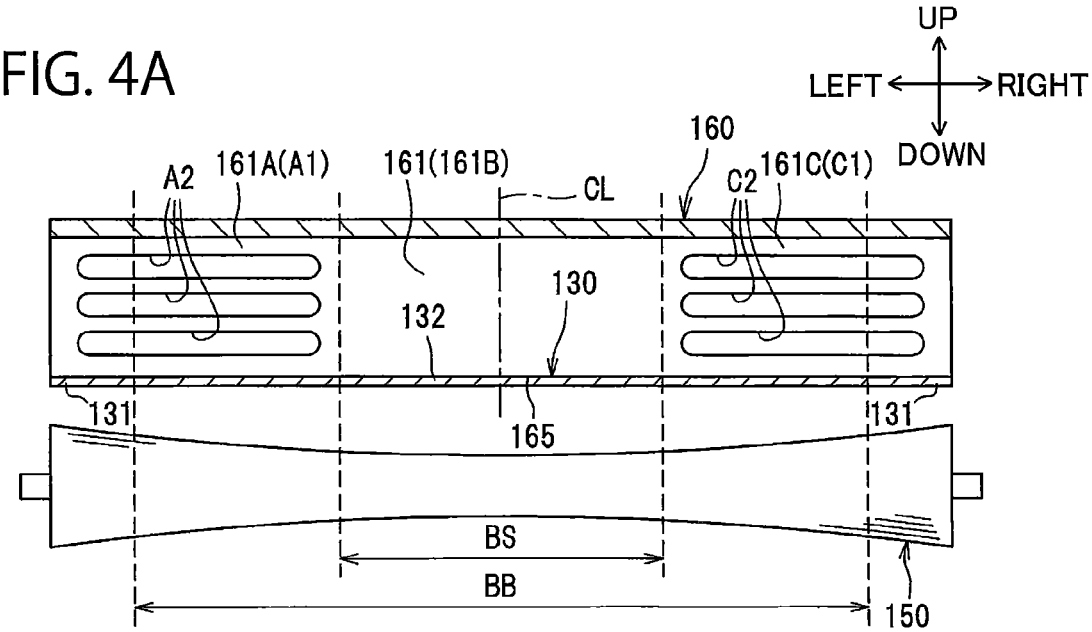
FIG. 4A and 4B are side views showing each position of the stay, the nip plate and the pressure roller.

In addition, as shown in FIG. 4A, the supporting portions 165 run in parallel with the leftward/rightward direction when not receiving reactive force from the nip plate 130, for instance when there is a paper jam and the nip plate 130 has been separated from the pressure roller 150. Incidentally, in FIGS. 4A and 4B, members such as the reflection plate 140 and the fusing belt 110 have been omitted for the sake of convenience.

Here, "when not receiving reactive force from the nip plate 130" includes conditions when the fixing device 100 has been disassembled and reactive force is not being placed on the supporting portions 165. In other words, it is acceptable for the fixing device 100 to be configured such that, as a fully assembled device, no mechanism is provided for releasing nip pressure, and the supporting portions 165 receive reactive force from the nip plate 130 uninterruptedly.

The first end portions 161A of the first walls 161 have respective low rigidity portions A1 that have a lower rigidity than that of a central portions 161B. Each of the low rigidity portions A1 has three holes A2 which are vertically arrayed with intervals therebetween, and which penetrate through the respective low rigidity portion A1 in the frontward/rearward direction. Further, in the same way, a second end portions 161C of the first walls 161 have respective low rigidity portions C1 which have a lower rigidity than that of the central portions 161B. Each of the low rigidity portions C1 has three holes C2 which are vertically arrayed with intervals therebetween, and which penetrate through the respective low rigidity portion C1 in the frontward/rearward direction.

Figure 4B:
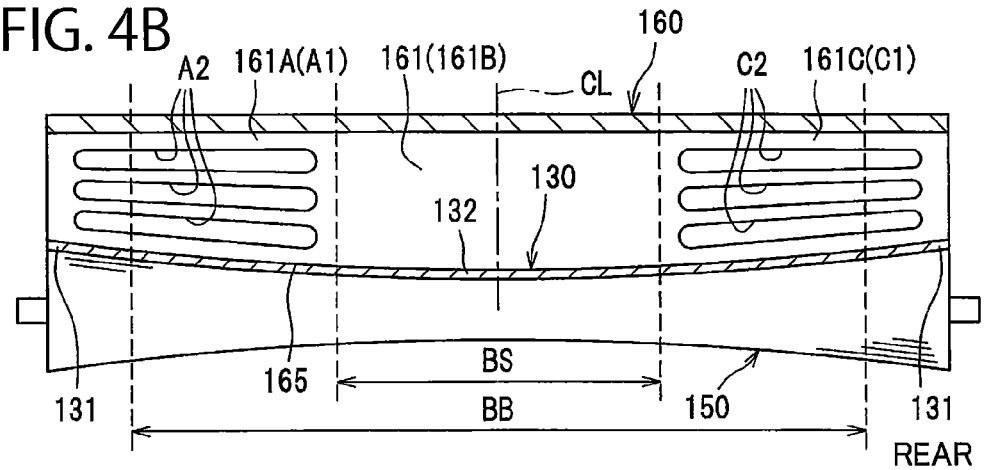

As a result of the end portions 161A and 161C of the first walls 161 having the respective low rigidity portions A1 and C1, when the supporting portions 165 of the stay 160 receive pressure from the nip plate 130, for instance during printing, the end portions 161A and 161C undergo more deformation than does the central portion 161B. As a result, the supporting portions 165 assume a convex shape, protruding toward the nip NP, as shown in FIG. 4B. More specifically, when the supporting portions 165 receive a load from the nip plate 130, the low rigidity portions A1 and C1 of the first end portions 161A and second end portions 161C bend in the upward/ downward direction, or become deformed outward in the frontward/rearward direction (in other words, become deformed such that the respective lower ends of the pair of first walls 161 open outward). In this way, the nip plate 130 can be imparted with an arcuate shape wherein the central portion 132 of the nip plate 130 protrudes further toward the pressure roller 150 than do the end portions 131 of the nip plate 130.

Thus, the protrusion amount of the central portion 132 is indirectly adjusted by adjusting the rigidity distribution of the first walls 161 in the leftward/rightward direction. Accordingly, errors in the protrusion amount can be reduced in comparison with configurations wherein the protrusion amount of a central portion of a nip member is adjusted directly by machining a surface of a nip member to be in contact with an endless belt, as is conventionally done.

In addition, each of the holes A2 and C2 is shaped such that a dimension thereof in the leftward/rightward direction is larger than a dimension thereof in the upward/downward direction. In this way, the first end portions 161A and second end portions 161C of the first walls 161 can be made more easily deformable in comparison with configurations wherein each of the holes is shaped such that a dimension thereof in the leftward/rightward direction is smaller than a dimension thereof in the upward/downward direction.

Figure 4C:
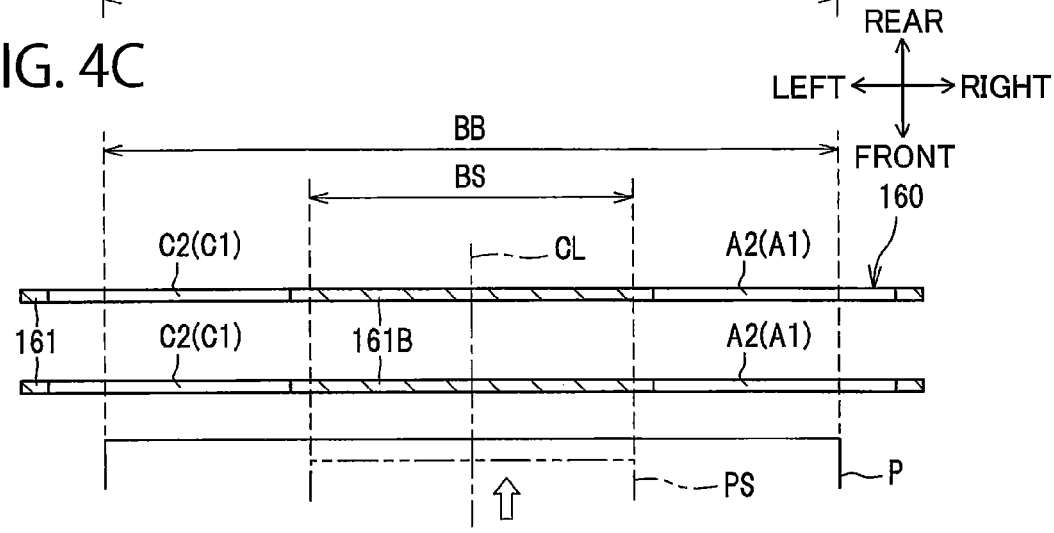
FIG. 4C is a bottom view showing a relationship between first walls and a sheet.

Further, as shown in FIG. 4C, each of the low rigidity portions A1 of the first end portions 161A of the first walls 161 is partly disposed within a sheet width BB in the leftward/rightward direction, and each of the low rigidity portions C1 of the second end portions 161C of the first walls 161 is partly disposed within the sheet width BB in the leftward/rightward direction. Here, the sheet width BB refers to a width of one of multiple types of sheets P that can be specified for the laser printer 1. In other words, the fixing device 100 is configured to convey sheets P within the nip region NP and a conveyance region having a prescribed width in the leftward/rightward direction (the same width as the sheet width BB shown). Here, the conveyance region can be defined as an area where the nip region NP and the conveyed sheet P overlaps with each other, when viewed in the vertical direction.

Incidentally, the sheet width BB for determining respective positions of the low rigidity portions A1 and C1 can be 176 mm to conform to B5 size, 215.9 mm to conform to letter or legal size, or 210 mm to conform to A4 size, of the International Organization for Standardization (ISO).

By thus locating the respective low rigidity portions A1 and C1 within the sheet width BB, the nip region NP within the applicable sheet width BB can be formed into a convex shape such as that described above, and wrinkling of the sheets P conforming to the sheet width BB can be prevented effectively.

In addition, the low rigidity portions A1, and the low rigidity portions C1 are symmetric relative to a conveyance center line CL of the sheet P. In other words, the low rigidity portions A1 and C1 are symmetric relative to a plane which contains the conveyance center line CL and is perpendicular to the leftward/rightward direction.

In this embodiment, the term "symmetric" includes configurations wherein the volume ratios between left and right sides of the conveyance center line CL are between 90 and 111 percent. The volume ratios between 92 and 109 percent, between 95 and 107 percent, between 95 and 105 percent, and between 93 and 107 percent are also acceptable.

In this way, the sheet P can be conveyed straight along the conveyance center line CL in comparison to configurations wherein respective low rigidity portions on first ends and second ends of first walls are not symmetric relative to a conveyance center line.

In addition, the rigidity distribution of the first walls 161 in the leftward/rightward direction is uniform within a minimum sheet width BS. Here, minimum sheet width BS refers to the width of a minimum size sheet PS that can be specified with the laser printer 1. In other words, the minimum sheet width BS depends on a minimum width guide on the sheet supply tray 31. For example, the minimum sheet width BS can be set to the width of postcards (100 mm).

In this way, the minimum size sheet PS can be conveyed on a straight path in the frontward/rearward direction in comparison to configurations wherein for instance the rigidity distribution of first walls in the leftward/rightward direction is not uniform within the minimum sheet width.

In addition to the effects described above, the present embodiment can also accomplish the effects described below. Since each of the frontward and rearward ends of the second wall 162 is provided with one of the first walls 161, the pair of low rigidity portions A1 and C1 of the respective first walls 161 can be bent away from each other in the frontward/rearward direction. Thus, the low rigidity portions A1 and C1 can be effectively deformed.

Moreover, the present invention is not limited to the aforementioned embodiment, and can be utilized in a variety of configurations, as described below. In the descriptions below, members with substantially the same structure as in the aforementioned embodiment are assigned the same symbols, and descriptions thereof are omitted.

Figure 5:
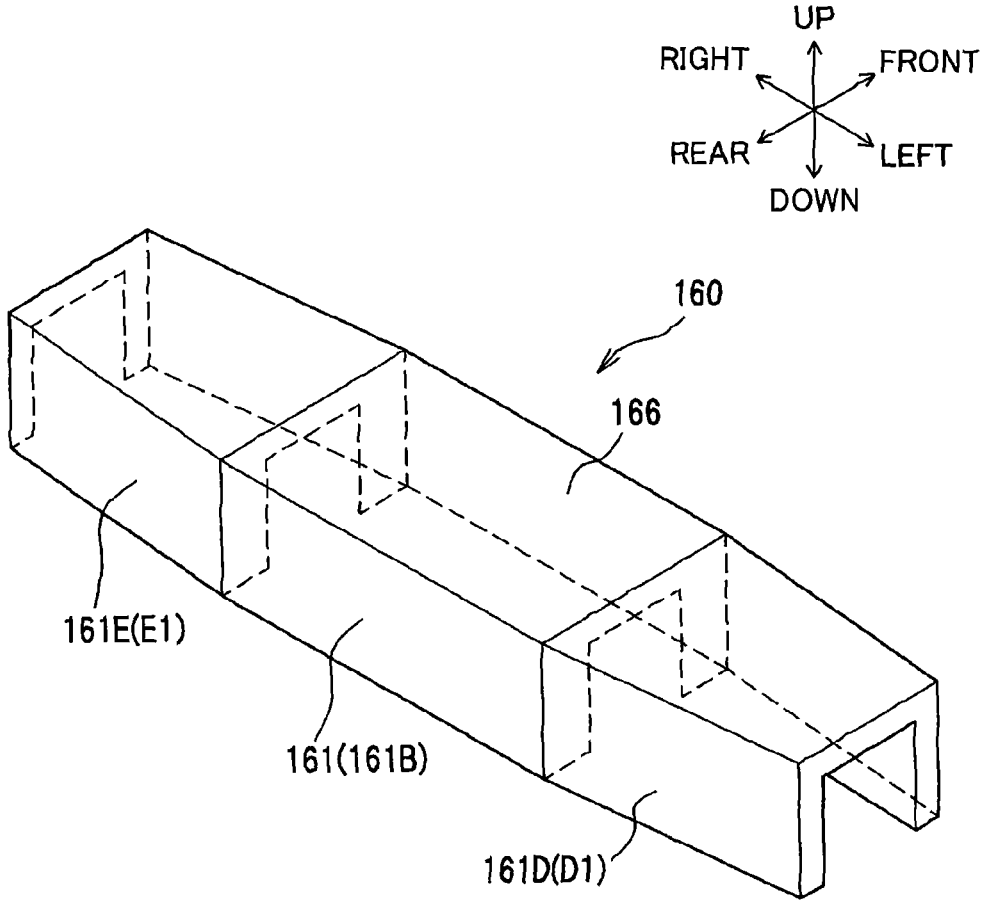
FIG. 5 is a perspective view showing a stay according to a first modification of the present invention.

With the above-described present embodiment, the low rigidity portions A1 and C1 are configured such that the holes A2 and C2 were formed in the end portions 161 A and 161 C of the first walls 161. However, the present invention is not limited to this configuration. For example, as shown in FIG. 5, low rigidity portions D1 and E1 can be configured such that end portions 161D and 161E of the first walls 161 are thin portions that have a lower degree of rigidity in the frontward/rearward direction than the rigidity of the 161B. Specifically, in this embodiment, the low rigidity portions D1 and E1 are configured so as to become progressively thinner in the course of extending outward from the second wall 166 in the leftward/rightward direction. Further, in this modification, regions of the second wall 166 which respectively correspond with the low rigidity portions D1 and E1 are configured so as to become progressively narrower in the frontward/rearward direction in the course of extending outward in the leftward/rightward direction.

Figure 6:
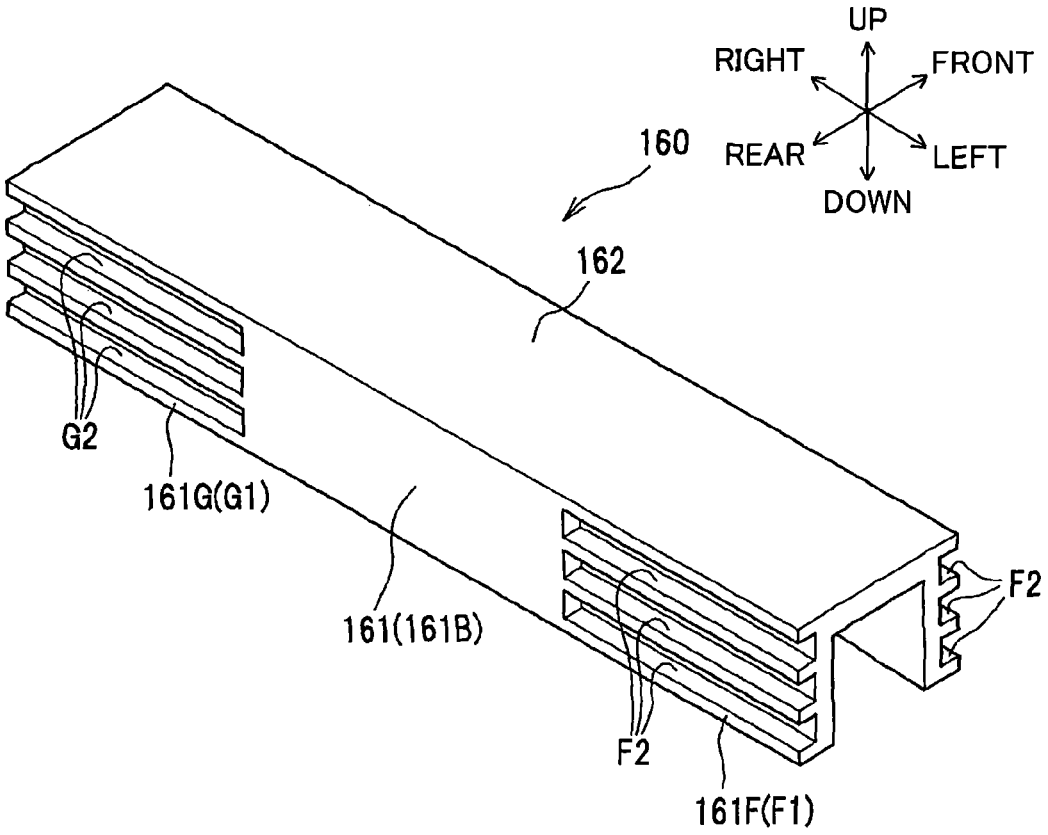
FIG. 6 is a perspective view showing a stay according to a second modification of the present invention.

In addition, as shown in FIG. 6, low rigidity portions F1 and G1 can be configured such that grooves F2 and G2 are formed in respective end portions 161F and 161G of the first walls 161. Specifically, in this embodiment, the low rigidity portions F1 and G1 are respectively provided with three grooves F2 and G2 which are vertically arrayed with spacing therebetween.

In addition, each of the grooves F2 and G2 is formed such that a dimension thereof in the leftward/rightward direction is larger than a dimension thereof in the upward/downward direction. In this way, the end portions 161 F and 161 G of the first walls 161 can be made more easily deformable in comparison with configurations wherein for instance each groove is formed such that a dimension thereof in the leftward/rightward direction is smaller than a dimension thereof in the upward/downward direction.

In the above-described embodiment, the frontward and rearward ends of the second wall 162 were each provided with one of the first walls 161, i.e. provided with a total of two first walls 161. However, the present invention is not limited to this configuration. Configurations are also available wherein there is only one first wall. For example, a stay with a T shape in a cross-sectional view can be configured by integrally forming a first wall and a second wall. In this configuration, the second portion extends in the frontward/rearward and leftward/rightward directions, and the first wall extends in the leftward/rightward and upward/downward directions. The supporting portion of the first wall connects onto a central portion in the frontward/rearward direction of the second wall. Incidentally, in this case, the supporting portion of the first wall indirectly supports a nip member through the second wall.

In the above-described embodiment, the supporting portions 165 indirectly support the nip plate 130 through the reflection plate 140. However, the present invention is not limited to this configuration. Configurations are also available wherein a supporting portion of a stay directly supports a nip member.

In the above-described embodiment, the supporting portions 165 are formed so as to extend from the first end to the second end, in the leftward/rightward direction, of the respective first walls 161. However, the present invention is not limited to this configuration. Supporting portions can be provided intermittently in the leftward/rightward direction. Specifically, a stay can have multiple supporting portions, with the respective supporting portions disposed with spacing therebetween in the leftward/rightward direction. Incidentally, in this case, a contour formed by connecting the intermittently provided supporting portions with straight lines can have a substantially arcuate shape.

In the above-described embodiment, each of the low rigidity portions A1 and C1 is partly disposed within the sheet width BB in the leftward/rightward direction. However, the present invention is not limited to this configuration. For example, each of the low rigidity portions A1 and C1 can be entirely disposed within the sheet width BB in the leftward/rightward direction.

In the above-described embodiment, the nip plate 130 is formed into a substantially planar shape. However, the present invention is not limited to this configuration. For example, as shown in FIG. 7A, a front portion 231 of a nip plate 230 can be formed into an arcuate shape bending upward. In this case, a lower end face of a first wall 261 at a front side of a stay 260 may be formed so as to be offset farther upward than a lower end face of the first wall 161 at a rear side of the stay 260, while a lower end face of a front wall 242 of a reflection plate 240 may be formed so as to be offset farther upward than a lower end face of a rear wall 243 of the reflection plate 240.

In other words, in this embodiment, a supporting portion 264 on the front side is disposed to a location which is offset farther upward than a supporting portion 265 on the rear side. In addition, in this embodiment, the lower end face of the first wall 261 at the front side bends frontward, and is thereby formed so as to be wide in the frontward/rearward direction. A portion (the supporting portion 264) of this wide lower end face supports a front end face 232 of the nip plate 230 through the reflection plate 240. Incidentally, in this modification, the supporting portion 264 refers to a surface spanning a region wherein, when viewed from the upward/downward direction, a portion of the wide lower end face of the first walls 261 overlaps with the front end face 232 of the nip plate 230.

Figure 7B:
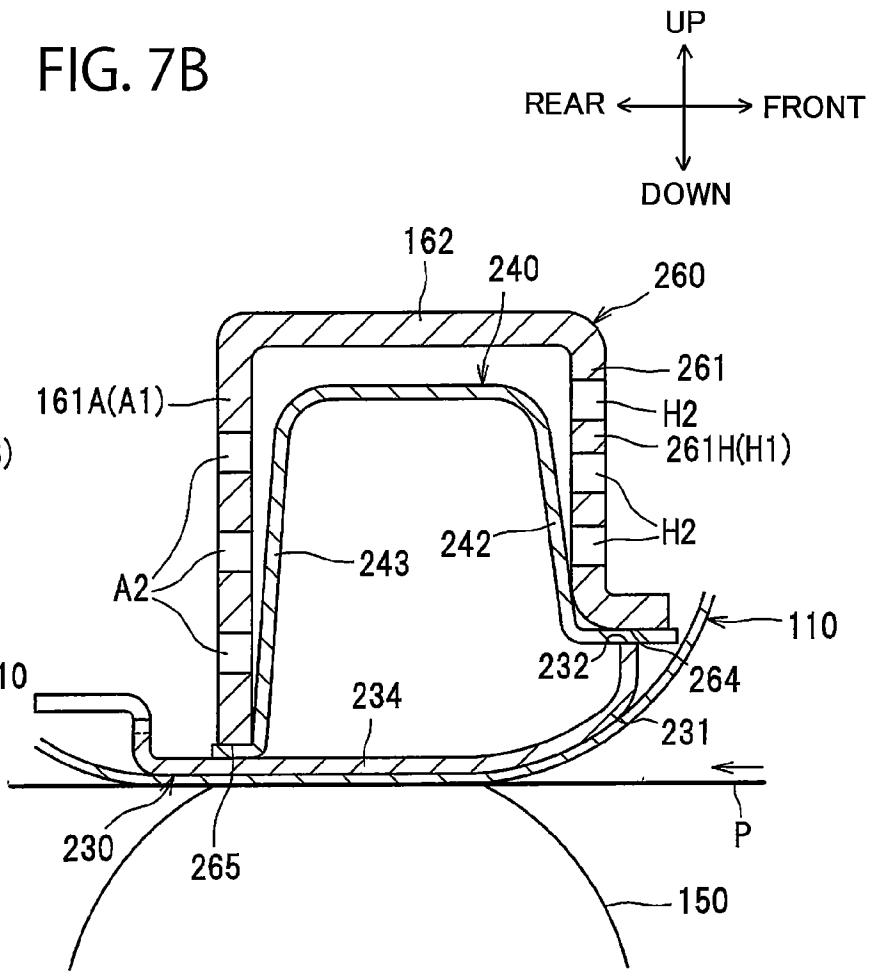
FIG. 7A and 7B are cross-sectional views showing an end portion and a central portion of a stay according to a third modification of the present invention.
Figure 7A:
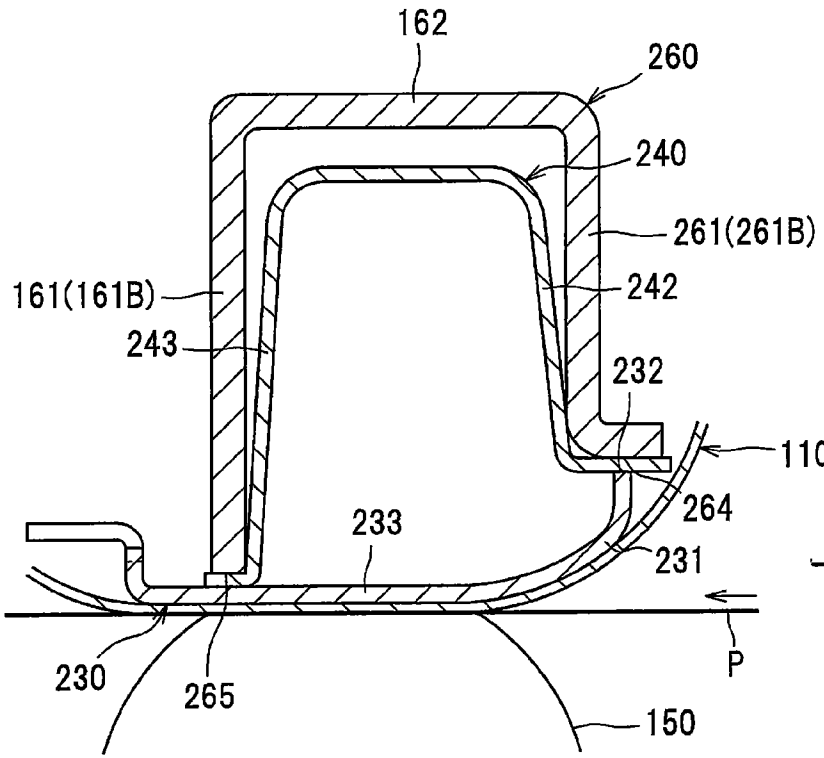

In this embodiment, as shown in FIGS. 7A and 7B, low rigidity portions A1 and H1 which have lower rigidity than that of central portions 161B and 261B, specifically low rigidity portions A1 and H1 which for instance have holes A2 and H2, are provided at the respective end portions 161A and 261H (of which end portions on only one side are shown). In this way, the same effect can be achieved as with the aforementioned embodiment. In other words, the nip plate 230 can be imparted with an arcuate shape wherein a central portion 233 in the leftward/rightward direction has a protrude amount toward the pressure roller 150 larger than that of a pair of end portions 234 in the leftward/rightward direction.

In the above-described embodiment, the pressure roller 150 as a rotating body was configured such that, when the fixing operation is not being performed, the respective diameters of the end portions 152A and 152C are larger than the diameter of the central portion 152B. However, the present invention is not limited to this configuration. A pressure roller can be configured such that, at least when fixing operation is being performed, diameters of end portions are larger than a diameter of a central portion.

As one example of the above configuration, the pressure roller can be configured to have a shaft, an elastic layer covering the shaft, and a tube over the elastic layer, wherein a first end portion and a second end portion of the tube in the axial direction have wrinkles. In this case, when fixing operation is not being performed, the respective end portions and the central portion of the pressure roller have substantially the same diameter. When fixing operation is being performed, i.e. when heat is applied to the pressure roller, the pressure roller expands to unwrinkle, and the respective diameters of the end portions of the pressure roller become larger than the diameter of the central portion.

As another example, the pressure roller can be configured to have a shaft and an elastic layer coating the shaft, wherein the respective diameters of a first end portion and a second end portion of the shaft are smaller than the diameter of a central portion of the shaft and, in addition, the diameter of the elastic layer is constant in the axial direction. In this case as well, when fixing operation is not being performed, the respective end portions and the central portion of the pressure roller have substantially the same diameter, but the elastic layer is thick at the end portions thereof and thin at the central portion thereof. When fixing operation is being performed, i.e. when heat is applied to the pressure roller, the end portions of the elastic layer expand more than the central portion of the elastic layer, and the respective diameters of the end portions of the pressure roller become larger than the diameter of the central portion of the pressure roller.

Further, the sheet P can be an OHP sheet instead of plain paper and a postcard.

Further, in the depicted embodiment, the pressure roller 150 is employed as a rotating body. However, a belt like pressure member is also available. In this modification, the axial direction of one of the rollers supporting the belt constitutes the axial direction of the rotating body.

Further, in the depicted embodiment, the image forming device is the monochromatic laser printer. However, a color laser printer, an LED printer, a copying machine, and a multifunction device are also available.

Further, in the depicted embodiment, the nip plate 130 is employed as a nip member. However, a block shaped member or a pad like member is also available.

Further, in the depicted embodiment, the halogen lamp 120 is employed as a heater. However, a carbon heater is also available.

What is claimed is:

1. A fixing device for fixing an image onto a recording sheet comprising:

a nip member;

an endless belt having an outer peripheral surface and an inner peripheral surface configured to be in sliding contact with the nip member;

a rotating body configured to nip the endless belt in cooperation with the nip member to form a nip region between the endless belt and the rotating body; and a stay disposed opposite to the nip region with respect to the nip member, and configured to receive a pressure from the nip member, a pressure direction from the nip member to the stay being defined as a first direction, the rotating body having an axis defining an axial direction as a second direction, the stay comprising a wall extending in the first direction and the second direction and having a thickness in a third direction perpendicular to the first direction and the second direction, the wall comprising:

a center portion;

a first end portion including a first low rigidity portion having a rigidity lower than that of the center portion;

a second end portion opposite to the first end portion with respect to the center portion in the second direction, the second end portion including a second low rigidity portion having a rigidity lower than that of the center portion;

and a supporting portion configured to support the nip member and receive the pressure, and configured to provide a convex shape protruding toward the nip member upon receiving the pressure.

2. The fixing device according to claim 1, wherein the first low rigidity portion has a through-hole penetrating in the third direction.

3. The fixing device according to claim 2, wherein the second low rigidity portion has another through-hole penetrating in the third direction.

4. The fixing device according to claim 3, wherein the through-hole has a length in the second direction longer than a length in the first direction; and wherein the other through-hole has a length in the second direction longer than a length in the first direction.

5. The fixing device according to claim 1, wherein the first low rigidity portion comprises a part having a thickness in the third direction smaller than that of the center portion.

6. The fixing device according to claim 1, wherein the second low rigidity portion comprises a part having a thickness in the third direction smaller than that of the center portion.

7. The fixing device according to claim 1, wherein at least a part of the first low rigidity portion is disposed within a width of the recording sheet; and wherein at least a part of the second low rigidity portion is disposed within a width of the recording sheet.

8. The fixing device according to claim 1, wherein the recording sheet has a width of 176 mm.

9. The fixing device according to claim 1, the recording sheet has a width of 215.9 mm.

10. The fixing device according to claim 1, wherein the recording sheet has a width of 210 mm.

11. The fixing device according to claim 1, wherein the first low rigidity portion and the second low rigidity portion provide a shape symmetrical with each other with respect to a conveyance center line of the recording sheet.

12. The fixing device according to claim 1, wherein the supporting portion extends in the second direction during a pressure-free situation.

13. The fixing device according to claim 1, wherein the first low rigidity portion has a first groove; and wherein the second low rigidity portion has a second groove.

14. The fixing device according to claim 13, wherein the first groove has a length in the second direction longer than a length in the first direction; and wherein the second groove has a length in the second direction longer than a length in the first direction.

15. The fixing device according to claim 1, wherein the stay further comprises another wall connected to the wall and extending in the second direction and the third direction, the other wall having a rigidity distribution substantially uniform in the second direction.

16. The fixing device according to claim 15, wherein the other wall has a first end and a second end in the third direction; and wherein the wall comprises a first part connected to the first end, and a second part connected to the second end.

17. The fixing device according to claim 1, wherein the wall has a rigidity distribution in the second direction, the rigidity distribution being uniform within a minimum width of the recording sheet.

18. The fixing device according to claim 1, wherein the rotating body is a roller having a first end part, an intermediate portion, and a second end part opposite to the first end part with respect to the intermediate portion in the second direction, the first end part and the second end part having diameters larger than a diameter of the intermediate portion at least during fixing operation.

19. The fixing device according to claim 18, wherein the first end part and the second end part have diameters larger than a diameter of the intermediate portion.

20. The fixing device according to claim 1, wherein the supporting portion extends in the second direction by a combined length, in the second direction, of the center portion, the first end portion and the second end portion.

* * * * *